US007293373B2

(12) United States Patent
Reagan et al.

(10) Patent No.: US 7,293,373 B2
(45) Date of Patent: Nov. 13, 2007

(54) LACE SYSTEM FOR FOOTWEAR

(75) Inventors: Greg Reagan, Essex, VT (US); Christopher Doyle, Waterbury, VT (US); Florian Lang, Colchester, VT (US); Maurizio Molin, Venice (IT)

(73) Assignee: The Burton Corporation, Burlington, VT (US)

( * ) Notice: Subject to any disclaimer, the term of this patent is extended or adjusted under 35 U.S.C. 154(b) by 13 days.

(21) Appl. No.: 11/286,643

(22) Filed: Nov. 23, 2005

(65) Prior Publication Data

US 2006/0075659 A1 Apr. 13, 2006

Related U.S. Application Data

(62) Division of application No. 10/732,834, filed on Dec. 10, 2003.

(51) Int. Cl.
*A43B 5/04* (2006.01)
*A43C 11/00* (2006.01)

(52) U.S. Cl. ..... 36/50.1; 36/50.5

(58) Field of Classification Search ..... 36/50.1, 36/50.5

See application file for complete search history.

(56) References Cited

U.S. PATENT DOCUMENTS 375,677 A 12/1887 Kyle
547,424 A 10/1895 Eaton
586,770 A 7/1897 Kempshall
599,906 A 3/1898 Kempshall
654,388 A 7/1900 Diemer
714,191 A 11/1902 Kempshall
737,769 A 9/1903 Preston
742,206 A 10/1903 Maurer (Continued)

FOREIGN PATENT DOCUMENTS

DE 3626837 2/1988

(Continued)

OTHER PUBLICATIONS

Internet web page advertising Rollerblade Aero 9 product, printed on May 13, 2003.

(Continued)

*Primary Examiner*—Marie Patterson
(74) *Attorney, Agent, or Firm*—Wolf, Greenfield & Sacks P.C.

(57) ABSTRACT

A boot incorporating techniques for making the process of tightening and loosening the laces of a boot more convenient for the wearer is disclosed. The boot may be provided with at least two independent lacing zones, the tensions of which are separately adjustable by the wearer. The zones may be secured by pulling on two laces, each of which tightens one of the two independent lacing zones. This arrangement allows the wearer to simultaneously tighten each zone, providing the wearer with the "feel" as though he or she is tightening a conventional single lacing zone boot. The laces may be simultaneously, yet independently secured by a lace lock at the upper and/or forward region of the boot. Slack may be created to facilitate loosening of the boot and easy removal of a foot from the boot by unhooking the lace from the lace guide without a corresponding distance of lace traveling through the lace lock. A release strap, graspable by the wearer, facilitates unhooking the lace.

27 Claims, 6 Drawing Sheets

U.S. PATENT DOCUMENTS

| | | | |
|---|---|---|---|
| 795,119 | A | 7/1905 | Harlow |
| 1,053,529 | A | 2/1913 | Neary |
| 1,090,438 | A | 3/1914 | Worth et al. |
| 1,242,774 | A | 10/1917 | Curry |
| 1,246,724 | A | 11/1917 | Daggett |
| 1,282,539 | A | 10/1918 | Carlson |
| 1,292,975 | A | 1/1919 | Valade |
| 1,371,637 | A | 3/1921 | Meredith |
| 1,429,657 | A | 9/1922 | Trawinski |
| 1,466,075 | A | 8/1923 | Triay, Jr. |
| 1,530,713 | A | 3/1925 | Clark |
| 1,608,214 | A | 11/1926 | Janke |
| 2,019,587 | A | 11/1935 | Tyrell |
| 2,022,554 | A | 11/1935 | Williams |
| 2,109,751 | A | 3/1938 | Matthias et al. |
| 2,284,814 | A | 6/1942 | Gookin |
| 2,345,057 | A | 3/1944 | Marinetti |
| 2,674,021 | A | 4/1954 | Cataldi |
| 2,871,537 | A | 2/1959 | Hickerson |
| 3,106,003 | A | 10/1963 | Herdman |
| 3,122,805 | A | 3/1964 | Hakim |
| 3,132,394 | A | 5/1964 | Russell |
| 3,176,362 | A | 4/1965 | Tarnes |
| 3,193,950 | A | 7/1965 | Liou |
| 3,221,384 | A | 12/1965 | Aufenacker |
| 3,229,340 | A | 1/1966 | Herdman |
| 3,239,903 | A | 3/1966 | Steinberg |
| 3,265,032 | A | 8/1966 | Hume |
| 3,321,815 | A | 5/1967 | Herdman |
| 3,333,304 | A | 8/1967 | Daddona |
| 3,430,303 | A | 3/1969 | Perrin et al. |
| 3,473,198 | A | 10/1969 | Meier |
| 3,546,796 | A | 12/1970 | Adams |
| 3,574,900 | A | 4/1971 | Emery |
| 3,618,232 | A | 11/1971 | Shnuriwsky |
| 3,631,613 | A | 1/1972 | Brettell |
| 3,703,775 | A | 11/1972 | Gatti |
| 3,710,486 | A | 1/1973 | Revny |
| 3,715,782 | A | 2/1973 | Newell |
| 3,731,350 | A | 5/1973 | Diebold |
| 3,812,811 | A | 5/1974 | Rodriguez |
| 3,834,048 | A | 9/1974 | Maurer |
| 3,908,238 | A | 9/1975 | Panicci |
| 3,934,346 | A | 1/1976 | Sasaki et al. |
| 3,988,810 | A | 11/1976 | Emery |
| 4,081,916 | A | 4/1978 | Salisbury |
| 4,084,532 | A | 4/1978 | Feder |
| 4,120,077 | A | 10/1978 | Fink |
| 4,125,918 | A | 11/1978 | Baumann |
| 4,142,307 | A | 3/1979 | Martin |
| 4,227,322 | A | 10/1980 | Annovi |
| 4,245,408 | A | 1/1981 | Larsen et al. |
| 4,261,081 | A | 4/1981 | Lott |
| 4,309,033 | A | 1/1982 | Parker, Jr. et al. |
| 4,333,649 | A | 6/1982 | Vaughn et al. |
| RE31,052 | E | 10/1982 | Adams |
| 4,361,938 | A | 12/1982 | Emery |
| 4,391,049 | A | 7/1983 | Parisotto |
| 4,397,253 | A | 8/1983 | Uecker et al. |
| 4,408,403 | A | 10/1983 | Martin |
| 4,426,756 | A | 1/1984 | Herdman |
| 4,433,456 | A | 2/1984 | Baggio |
| 4,442,613 | A | 4/1984 | Dobbin |
| 4,519,625 | A | 5/1985 | Luitz et al. |
| 4,536,975 | A | 8/1985 | Harrell |
| 4,538,367 | A | 9/1985 | Adams |
| 4,592,154 | A | 6/1986 | Oatman |
| 4,616,524 | A | 10/1986 | Bidoia |
| 4,622,763 | A | 11/1986 | Adams |
| 4,630,383 | A | 12/1986 | Gamm |
| 4,633,548 | A | 1/1987 | Siskind et al. |
| 4,633,599 | A | 1/1987 | Morell et al. |
| 4,638,579 | A | 1/1987 | Gamm |
| 4,640,025 | A | 2/1987 | DeRenzo |
| 4,653,204 | A | 3/1987 | Morell et al. |
| 4,660,300 | A | 4/1987 | Morell et al. |
| 4,698,922 | A | 10/1987 | Sartor |
| 4,715,094 | A | 12/1987 | Herdman |
| 4,726,126 | A | 2/1988 | Bernhard |
| 4,727,660 | A | 3/1988 | Bernhard |
| 4,766,682 | A | 8/1988 | Malloy, III |
| 4,787,124 | A | 11/1988 | Pozzobon et al. |
| 4,799,297 | A | 1/1989 | Baggio et al. |
| 4,802,291 | A | 2/1989 | Sartor |
| 4,805,270 | A | 2/1989 | Kimbrough |
| 4,856,207 | A | 8/1989 | Datson |
| 4,858,282 | A | 8/1989 | DuPont |
| 4,877,167 | A | 10/1989 | McNemar |
| 4,884,760 | A | 12/1989 | Baggio et al. |
| 4,893,419 | A | 1/1990 | Arieh |
| 4,896,403 | A | 1/1990 | Vouros |
| 4,937,952 | A | 7/1990 | Olivieri |
| 4,937,953 | A | 7/1990 | Walkhoff |
| 4,956,897 | A | 9/1990 | Speedie |
| 4,961,544 | A | 10/1990 | Bidoia |
| 4,969,242 | A | 11/1990 | Carlton, Sr. |
| 4,999,888 | A | 3/1991 | Miller |
| 4,999,889 | A | 3/1991 | LeCouturer |
| 5,001,817 | A | 3/1991 | De Bortoli et al. |
| 5,003,711 | A | 4/1991 | Nerrinck et al. |
| 5,012,598 | A | 5/1991 | Baggio et al. |
| 5,016,327 | A | 5/1991 | Klausner |
| 5,027,482 | A | 7/1991 | Torppey |
| 5,029,371 | A | 7/1991 | Rosenblood et al. |
| 5,042,119 | A | 8/1991 | Williams |
| 5,042,120 | A | 8/1991 | Nichols |
| 5,042,177 | A | 8/1991 | Schoch |
| 5,048,204 | A | 9/1991 | Tacchetto et al. |
| 5,067,736 | A | 11/1991 | Olson et al. |
| 5,074,013 | A | 12/1991 | Arnold et al. |
| 5,088,166 | A | 2/1992 | Lavinio |
| 5,092,614 | A | 3/1992 | Malewicz |
| 5,117,567 | A | 6/1992 | Berger |
| 5,129,130 | A | 7/1992 | Lecouturier |
| 5,152,038 | A | 10/1992 | Schoch |
| 5,157,813 | A | 10/1992 | Carroll |
| 5,158,428 | A | 10/1992 | Gessner et al. |
| 5,158,559 | A | 10/1992 | Pozzobon et al. |
| 5,170,573 | A | 12/1992 | Clinch |
| 5,171,033 | A | 12/1992 | Olson et al. |
| 5,177,882 | A | 1/1993 | Berger |
| 5,181,331 | A | 1/1993 | Berger |
| 5,189,818 | A | 3/1993 | Skaja |
| 5,190,301 | A | 3/1993 | Malewicz |
| 5,205,055 | A | 4/1993 | Harrell |
| 5,249,377 | A | 10/1993 | Walkhoff |
| 5,271,130 | A | 12/1993 | Batra |
| 5,295,315 | A | 3/1994 | Osawa et al. |
| 5,319,868 | A | 6/1994 | Hallenbeck |
| 5,319,869 | A | 6/1994 | McDonald et al. |
| 5,325,613 | A | 7/1994 | Sussmann |
| 5,327,662 | A | 7/1994 | Hallenbeck |
| 5,331,752 | A | 7/1994 | Johnson et al. |
| 5,341,583 | A | 8/1994 | Hallenbeck |
| 5,345,697 | A | 9/1994 | Quellais |
| 5,349,764 | A | 9/1994 | Posner |
| 5,351,420 | A | 10/1994 | Pozzobon et al. |
| 5,353,483 | A | 10/1994 | Louviere |
| 5,355,596 | A | 10/1994 | Sussmann |
| 5,357,691 | A | 10/1994 | Hyde et al. |
| 5,388,315 | A | 2/1995 | Jones |
| 5,412,883 | A | 5/1995 | Wulf et al. |
| 5,421,106 | A | 6/1995 | Emrick |
| 5,425,161 | A | 6/1995 | Schoch |

| | | | | |
|---|---|---|---|---|
| 5,463,822 | A | 11/1995 | Miller | |
| 5,467,511 | A | 11/1995 | Kubo | |
| 5,467,537 | A | 11/1995 | Aveni et al. | |
| 5,471,769 | A | 12/1995 | Sink | |
| 5,477,593 | A | 12/1995 | Leick | |
| 5,485,688 | A | 1/1996 | Gorza et al. | |
| 5,502,902 | A | 4/1996 | Sussmann | |
| 5,511,325 | A | 4/1996 | Hieblinger | |
| 5,526,585 | A | 6/1996 | Brown et al. | |
| 5,535,531 | A | 7/1996 | Karabed et al. | |
| 5,537,763 | A | 7/1996 | Donnadieu et al. | |
| 5,564,203 | A | 10/1996 | Morris | |
| 5,566,474 | A | 10/1996 | Leick et al. | |
| 5,566,477 | A | 10/1996 | Mathis et al. | |
| D375,677 | S | 11/1996 | Gaultier | |
| 5,570,522 | A | 11/1996 | Olson et al. | |
| D376,041 | S | 12/1996 | Nitz | |
| D377,410 | S | 1/1997 | Crowley | |
| 5,606,778 | A | 3/1997 | Jungkind | |
| 5,640,785 | A | 6/1997 | Egelja | |
| 5,647,104 | A | 7/1997 | James | |
| 5,649,342 | A | 7/1997 | D'Andrade et al. | |
| 5,651,197 | A | 7/1997 | James | |
| 5,651,198 | A | 7/1997 | Sussmann | |
| 5,671,517 | A | 9/1997 | Gourley | |
| 5,675,872 | A | 10/1997 | Emery | |
| 5,692,319 | A | 12/1997 | Parker et al. | |
| 5,701,688 | A | 12/1997 | Crowley | |
| 5,718,021 | A | 2/1998 | Tatum | |
| 5,737,854 | A | 4/1998 | Sussmann | |
| 5,755,044 | A | 5/1998 | Veylupek | |
| 5,761,777 | A | 6/1998 | Leick | |
| 5,765,841 | A | 6/1998 | Johnson et al. | |
| 5,775,011 | A | 7/1998 | Reitano | |
| 5,778,500 | A | 7/1998 | Illingworth | |
| 5,791,021 | A | 8/1998 | James | |
| 5,791,068 | A | 8/1998 | Bernier et al. | |
| 5,839,210 | A | 11/1998 | Bernier et al. | |
| 5,848,457 | A | 12/1998 | Silagy | |
| 5,873,183 | A | 2/1999 | Posner | |
| 5,906,057 | A | 5/1999 | Borsoi | |
| 5,909,946 | A | 6/1999 | Okajima | |
| 5,913,483 | A | 6/1999 | Polk | |
| 5,918,352 | A | 7/1999 | Galbreath | |
| 5,934,599 | A | 8/1999 | Hammerslag | |
| 5,937,542 | A | 8/1999 | Bourdeau | |
| 5,947,487 | A | 9/1999 | Keleny et al. | |
| 5,956,823 | A | 9/1999 | Borel | |
| 5,966,841 | A | 10/1999 | Barret | |
| 5,979,080 | A | 11/1999 | Borsoi | |
| 5,983,530 | A | 11/1999 | Chou | |
| 5,996,256 | A * | 12/1999 | Zebe, Jr. | 36/50.1 |
| 6,000,111 | A | 12/1999 | Deskins et al. | |
| 6,029,323 | A | 2/2000 | Dickie et al. | |
| 6,029,375 | A | 2/2000 | Borel | |
| 6,032,387 | A | 3/2000 | Johnson | |
| 6,038,791 | A | 3/2000 | Cornelius et al. | |
| 6,070,886 | A | 6/2000 | Cornelius et al. | |
| 6,070,887 | A | 6/2000 | Cornelius et al. | |
| 6,073,370 | A | 6/2000 | Okajima | |
| 6,076,241 | A | 6/2000 | Borel | |
| 6,102,412 | A | 8/2000 | Staffaroni | |
| 6,119,318 | A | 9/2000 | Maurer | |
| 6,119,372 | A | 9/2000 | Okajima | |
| 6,128,801 | A | 10/2000 | Adzick et al. | |
| 6,148,489 | A | 11/2000 | Dickie | |
| 6,202,953 | B1 | 3/2001 | Hammerslag | |
| 6,219,891 | B1 | 4/2001 | Maurer et al. | |
| D442,771 | S | 5/2001 | Haas | |
| D442,772 | S | 5/2001 | Dietrich | |
| 6,233,790 | B1 | 5/2001 | Carothers | |
| 6,240,657 | B1 | 6/2001 | Weber et al. | |
| 6,289,558 | B1 | 9/2001 | Hammerslag | |
| 6,295,704 | B1 | 10/2001 | Rivas | |
| 6,305,103 | B1 | 10/2001 | Camargo | |
| 6,324,773 | B1 | 12/2001 | Gaither | |
| 6,324,774 | B1 | 12/2001 | Zebe, Jr. | |
| 6,327,750 | B1 | 12/2001 | Muldowney et al. | |
| 6,338,186 | B1 | 1/2002 | Kleinmann | |
| D453,413 | S | 2/2002 | Tsujino et al. | |
| 6,357,093 | B1 | 3/2002 | Takahashi | |
| 6,367,169 | B1 | 4/2002 | Barret | |
| 6,378,230 | B1 | 4/2002 | Rotem et al. | |
| 6,405,457 | B1 | 6/2002 | Basso et al. | |
| 6,416,074 | B1 | 7/2002 | Maravetz et al. | |
| 6,427,361 | B1 | 8/2002 | Chou | |
| 6,457,260 | B1 | 10/2002 | Roelofs | |
| 6,467,193 | B1 | 10/2002 | Okajima | |
| 6,467,194 | B1 | 10/2002 | Johnson | |
| 6,467,195 | B2 | 10/2002 | Pierre et al. | |
| 6,473,999 | B2 | 11/2002 | Fellouhe | |
| 6,502,329 | B1 | 1/2003 | Silagy | |
| 6,513,211 | B1 | 2/2003 | Fisher | |
| 6,532,688 | B2 | 3/2003 | Bouvier | |
| 6,560,898 | B2 | 5/2003 | Borsoi et al. | |
| 6,568,103 | B2 | 5/2003 | Durocher | |
| 6,601,323 | B2 | 8/2003 | Tsujino et al. | |
| 6,729,000 | B1 | 5/2004 | Liu | |
| 6,802,439 | B2 * | 10/2004 | Azam et al. | 223/113 |
| 6,952,890 | B1 * | 10/2005 | Blakeslee | 36/50.1 |
| 2001/0001906 | A1 | 5/2001 | Borosi | |
| 2001/0002518 | A1 | 6/2001 | Morrow et al. | |
| 2001/0007178 | A1 * | 7/2001 | Pierre et al. | 36/50.5 |
| 2001/0025434 | A1 | 10/2001 | Fellouhe | |
| 2002/0002781 | A1 * | 1/2002 | Bouvier | 36/50.1 |
| 2002/0046476 | A1 | 4/2002 | Snyder | |
| 2002/0050076 | A1 | 5/2002 | Borsoi et al. | |
| 2002/0078597 | A1 | 6/2002 | Burt | |
| 2002/0083620 | A1 | 7/2002 | Tsujino et al. | |
| 2002/0083621 | A1 | 7/2002 | Durocher | |
| 2002/0095750 | A1 | 7/2002 | Hammerslag | |
| 2002/0144435 | A1 | 10/2002 | Shepherd | |
| 2002/0170205 | A1 | 11/2002 | Shepherd | |
| 2003/0034365 | A1 | 2/2003 | Azam et al. | |
| 2003/0041478 | A1 | 3/2003 | Liu | |
| 2003/0051374 | A1 | 3/2003 | Freed | |
| 2003/0226284 | A1 * | 12/2003 | Grande et al. | 36/50.5 |
| 2004/0078999 | A1 | 4/2004 | Freed | |
| 2005/0097780 | A1 * | 5/2005 | Pellegrini | 36/54 |
| 2006/0174516 | A1 * | 8/2006 | Peruzzo | 36/50.5 |

FOREIGN PATENT DOCUMENTS

| | | |
|---|---|---|
| DE | 3813470 | 11/1989 |
| DE | 19624553 | 1/1998 |
| DE | 20116755 | 1/2002 |
| DE | 101 16 779 C1 | 7/2002 |
| EP | 0018074 | 10/1980 |
| EP | 0255869 | 2/1988 |
| EP | 0393380 | 10/1990 |
| EP | 0395536 | 10/1990 |
| EP | 0395537 | 10/1990 |
| EP | 0465222 | 1/1992 |
| EP | 0465223 | 1/1992 |
| EP | 0466459 | 1/1992 |
| EP | 0503877 | 9/1992 |
| EP | 0679346 | 11/1995 |
| EP | 0717942 | 6/1996 |
| EP | 0734662 | 10/1996 |
| EP | 0857501 | 8/1998 |
| EP | 0858819 | 8/1998 |
| EP | 0858821 | 8/1998 |
| EP | 0923965 | 6/1999 |
| EP | 0937487 | 8/1999 |
| EP | 0848917 | 4/2000 |
| EP | 1219195 | 7/2002 |

| | | | |
|---|---|---|---|
| FR | 1182409 | | 6/1959 |
| FR | 1349832 | | 12/1963 |
| FR | 1404799 | | 5/1965 |
| FR | 2689732 | A3 * | 10/1993 |
| FR | 2726440 | | 5/1996 |
| FR | 2766068 | | 1/1999 |
| FR | 2 770 379 | A | 5/1999 |
| FR | 2 770 379 | A1 | 5/1999 |
| FR | 2814919 | | 4/2002 |
| GB | 1010686 | | 11/1965 |
| GB | 1463362 | | 2/1977 |
| GB | 2041765 | | 9/1980 |
| GB | 2046826 | | 11/1980 |
| JP | 7-19152 | | 6/1932 |
| JP | 50-22459 | | 7/1975 |
| JP | 1-124103 | | 8/1989 |
| JP | 5-58008 | | 1/1992 |
| JP | 7-33106 | | 12/1993 |
| JP | 2001-197905 | | 7/2001 |
| JP | 2002-360309 | | 12/2002 |
| JP | 2003-518397 | | 6/2003 |
| JP | 2004-41666 | | 2/2004 |
| WO | WO 95/11602 | | 5/1995 |
| WO | WO 95/31119 | | 11/1995 |
| WO | WO 95/32030 | | 11/1995 |
| WO | WO 9728713 | A1 * | 8/1997 |
| WO | WO 98/37782 | | 9/1998 |
| WO | WO 99/09850 | | 3/1999 |
| WO | WO 99/15043 | | 4/1999 |
| WO | WO 00/53045 | | 9/2000 |
| WO | WO 01/08525 | | 2/2001 |
| WO | WO 01/47386 | A1 | 7/2001 |
| WO | WO 02/051511 | | 7/2002 |
| WO | WO 2004/093589 | A1 | 11/2004 |

OTHER PUBLICATIONS

Internet web page reviewing Salomon TR8 / TR8 II product, printed on May 13, 2003.

* cited by examiner

LACE SYSTEM FOR FOOTWEAR

CROSS-REFERENCE TO RELATED APPLICATIONS

This application claims the benefit under 35 U.S.C. § 120 of U.S. application Ser. No. 10/732,834, filed on Dec. 10, 2003, which is herein incorporated by reference in its entirety.

FIELD

This invention relates generally to tightening arrangements for articles of footwear, and more particularly to lacing systems for boots, including snowboard boots.

BACKGROUND

Boots conventionally comprise a lace threaded back and forth through the medial and lateral sides of the boot. Typically, the lace has two free ends protruding from the top portion of the boot, which a wearer can pull to tighten the boot around his or her foot and leg.

The same is true of many snowboard boots, particularly snowboard boots of the "soft" variety. Soft boots, as their name suggests, typically are comprised of softer materials (e.g., leather, fabric, and/or thin plastic components) that are more flexible than the relatively rigid, typically molded plastic shell of a hard boot. Soft boots are generally more comfortable and easier to walk in than hard boots, and are often favored by riders who engage in recreational, "freestyle" or trick-oriented snowboarding. Tightening a soft boot typically involves pulling on both ends of the lace and tying the lace in a knot or bow.

Frequently, the lace is sufficiently long, and threaded back and forth sufficiently many times, that tightening the lace merely by pulling on its free ends can be difficult due to friction between the lace and the portions of the boot (e.g., eyelets or lace guides) through which the lace is guided. Accordingly, a wearer often must tighten the lace progressively from the bottom to the top of the boot, culminating with the wearer pulling on the free ends of the lace. Despite these efforts, the wearer may still experience an undesirable tightness and discomfort in part of the boot. To address this concern, boots having "zone lacing" have been developed in which separate areas or "zones" of the boot may be independently tightened so that a wearer can adjust the level of tightness desired in a particular area. However, such lacing systems lack a convenient arrangement for tightening the laces.

Also, prior lacing systems, whether incorporating "zone lacing" or not, typically include laces having long free ends to permit grasping, pulling and tying the lace. The free ends can become untied and hang loose from the boot. Lacing systems with short lace ends would be beneficial; however, striking a balance between a sufficiently short lace and a one having enough length to provide slack facilitating removal of the boot is challenging.

SUMMARY

One illustrative embodiment is directed to a boot having a boot body with a lower region adapted to cover a foot of a wearer and an upper region adapted to cover at least a portion of a shin of the wearer. The boot also includes a first lacing zone comprising a first lace adapted to tighten a first region of the boot and a second lacing zone comprising a second lace adapted to tighten a second region of the boot. The first and second laces have portions that are disposed at the upper region. Both the first lace and the second lace are simultaneously securable at the upper region of the boot.

Another illustrative embodiment is directed to a boot having a boot body with a lower region adapted to cover a foot of a wearer, an upper region adapted to cover at least a portion of a shin of the wearer, and a rear side that faces backward when the boot is worn by the wearer. The boot also includes a first lacing zone comprising a first lace adapted to tighten a first region of the boot and a second lacing zone comprising a second lace adapted to tighten a second region of the boot, The first and second laces have portions that are disposed at the upper region. Both the first lace and the second lace are simultaneously securable at a location forward of the rear side to completely secure the boot body to the wearer.

A further illustrative embodiment is directed to a boot having a boot body, a plurality of lace guides coupled to the boot body, and at least one lace guided by the lace guides. At least one of the lace guides includes a lace hook and the at least one lace is adapted to be dislodged from the hook. The boot further includes at least one lace lock engageable with the at least one lace so that the boot may be tightened to the wearer, and a release strap coupled to the at least one lace. The release strap is graspable to remove the at least one lace from the hook to so as to create slack in the at least one lace.

Another illustrative embodiment is directed to a boot having a boot body, a plurality of lace guides coupled to the boot body, and at least one lace guided by the lace guides. At least one of the lace guides includes a lace hook and the at least one lace is adapted to be dislodged from the hook. The boot further includes at least one lace lock engageable with the at least one lace so that the boot may be tightened to the wearer. An amount of slack lace created upon removing the at least one lace from the hook is greater than an amount of slack lace that would otherwise be created upon disengaging the at least one lace from the at least one lace lock.

Yet another illustrative embodiment is directed to a boot comprising a boot body, a plurality of lace guides coupled to the boot body, and at least one lace guided by the lace guides. At least one of the lace guides includes a lace hook and the at least one lace is adapted to be dislodged from the hook. The boot further includes at least one lace lock engageable with the at least one lace so that the boot may be tightened to a wearer. The at least one lace is adapted to have a free-end portion extending from the at least one lace lock after the at least one lace has been tightened. An amount of slack lace provided by the free-end portion of the at least one lace upon disengaging the at least one lace from the at least one lock is insufficient to permit easy removal of the boot from the wearer and an amount of slack lace created upon removing the at least one lace from the lace hook aids in permitting easy removal of the boot from the wearer.

A further illustrative embodiment is directed to a method of using a boot. The boot has a boot body, a plurality of lace guides coupled to the boot body, at least one lace guided by the lace guides, and at least one lace lock cooperating with the at least one lace and engaging the at least one lace so that the at least one lace is holdable toward a tightening direction to tighten the boot body about the wearer. The at least one lace is adapted to have a free-end portion extending from the at least one lace lock after the at least one lace has been tightened. An amount of slack lace provided by the free-end portion of the at least one lace upon disengaging the at least one lace from the at least one lock may be insufficient to permit easy removal of the boot from the wearer. The method includes removing the at least one lace from at least one lace guide to create a length of slack in the at least one lace to aid in permitting removal of the foot from the boot, and drawing the lace through at least one of the other lace guides in a loosening direction.

Yet another illustrative embodiment is directed to a soft snowboard boot. The boot includes a boot body formed of flexible material, with the boot body having a lower region adapted to cover a foot of a rider and an upper region adapted to cover at least a portion of a shin of the rider. A plurality of lace guides is mounted to the boot body, and at least one of the lace guides comprising a lace hook. The boot also includes a first lacing zone having a first lace and a first lace lock mounted to the boot body in the upper region. The first lace is guided by the lace guides and cooperates with the lower region. The first lace is adapted to extend through and engage with the first lace lock to tighten the lower region. The first lace has a portion that extends from the lower region to the upper region so as to be engageable with the first lace lock. The boot further includes a second lacing zone having a second lace and a second lace lock mounted to the boot body in the upper region. The second lace is guided by the lace guides and the lace hook and cooperates with the upper region. The second lace is adapted to extend through and engage with the second lace lock to tighten the upper region. Both the first and second laces may be simultaneously secured by the first and second lace locks, respectively, in the upper region of the boot body forward of a rear side of the boot body. A release strap is coupled to the second lace and is graspable to remove the second lace from the hook so as to create slack in the second lace.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

Various embodiments of the invention will now be described, by way of example, with reference to the accompanying drawings, in which.

DETAILED DESCRIPTION

Figure 1:
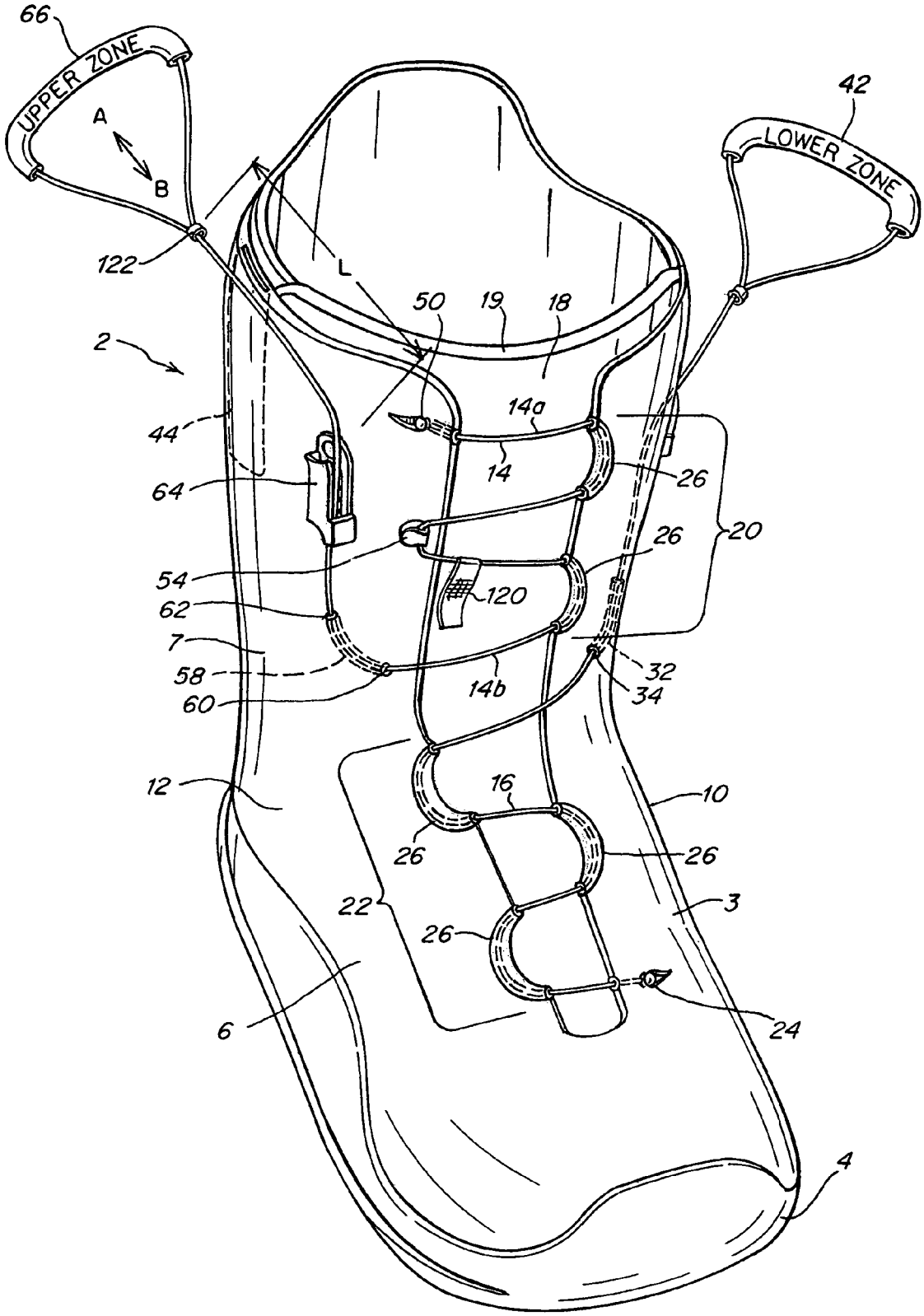
FIG. 1 is a perspective view of one illustrative embodiment of the boot of the present invention.

The boot of the present invention includes arrangement(s) and/or technique(s) for making the process of tightening and loosening the laces of a boot more convenient for the wearer.

In one aspect, the boot is provided with at least two independent lacing zones, the tensions of which are separately adjustable by the wearer, thereby increasing comfort, flexibility and/or performance for the wearer. Thus, the wearer can choose (for example) for part of the boot to fit more tightly, and for another part of the boot to fit less tightly.

To provide the wearer of the boot of the present invention with the familiar sensation that accompanies tightening conventionally laced boots, in one embodiment, the zones may be tightened by pulling on two lace ends, each of which emerges from a lacing zone at about the same location typical of a conventionally laced boot, i.e., at the upper and/or forward region of the boot. In one embodiment, each zone is tightened with a separate lace. The sensation of tightening the boot by pulling on, and securing, two laces at the upper and/or forward region of the boot is similar to that accompanying the use of a conventional boot lace.

This arrangement allows the wearer to simultaneously tighten each zone, providing the wearer with a "feel" as though he or she is tightening a conventional boot having a single lacing zone, while still obtaining the benefits of tightening a particular zone to a desired tension. In one embodiment, the laces may be simultaneously, yet independently, secured. Although in this aspect, the lacing arrangement allows the wearer to simultaneously secure the laces, the wearer need not do so. Rather, the system of this embodiment merely provides the wearer with the option to simultaneously secure the laces of each zone. In an alternative embodiment, for example, the wearer may first secure the lower lace, after which the wearer secures the upper lace.

Another aspect of the invention relates to creating slack in a lace to facilitate loosening and removing the boot. In this aspect, a balance is struck between employing a relatively short lace end and providing sufficient lace slack to facilitate removing the boot. In one embodiment, the boot includes a lace lock for securing the end of the lace, and one or more lace guides formed as open hooks (also referred to herein as "speed hooks"), provided on the boot. The wearer can unhook the lace from the speed hook to create slack in the lace without a corresponding distance of lace traveling through the lace lock. In one embodiment, a pull tab or release strap, graspable by the wearer, is coupled to the lace to facilitate unhooking the lace from the speed hook. In this manner, lace slack may be created quickly and easily to facilitate removal of the boot. An additional benefit may be minimizing wear of the lace resulting from travel of the lace through the lace lock.

The above aspects of the invention may be employed in any suitable combination as the present invention is not limited in this respect. Also, any or all of the above aspects may be employed in a snowboard boot; however, the present invention is not limited in this respect, as aspects of the invention may be used on any type of footwear, including boots and snowboard boots. Various aspects and embodiments of the invention will now be described in more detail with respect to the accompanying drawing figures. The invention is not, however, limited to the aspects and embodiments shown.

A boot 2 (which may be formed as a snowboard boot) in accordance with one embodiment of the present invention that incorporates the above-discussed aspects is illustrated in FIGS. 1-5. The boot 2 has a boot body 3 (also referred to as a boot upper) and a sole 4 (typically formed of rubber). Boot body 3 has a lower region 6 adapted to cover the foot of a wearer, and an upper region 7 adapted to cover at least a portion of the wearer's shin. Boot body 3 includes a tongue opening 18 disposed in a shin-to-toe direction, and a tongue 19 disposed within the tongue opening 18, and attached at a lower end portion to the boot body 3, in a conventional manner known in the art.

The boot 2 shown in the figures is configured for the right foot of a wearer, and comprises medial side 10 and lateral side 12. (Herein, the term "lateral side" is used to refer to the side of a boot facing outward and away from the wearer, i.e., the left side of the left boot and the right side of the right boot, when worn by the wearer. The term "medial side" is used to refer to the side of a boot facing inward toward the wearer's other foot, i.e., the right side of the left boot and the left side of the right boot, when worn by the wearer.) Upper lace 14 and lower lace 16 are threaded through medial and lateral sides 10 and 12 of boot 2. Upper lace 14 and lower lace 16 can be used to tighten boot 2 (and, correspondingly, to reduce the width of tongue opening 18 between medial side 10 and lateral side 12).

In the embodiment shown in FIGS. 1-5, the boot comprises two lacing zones—upper lacing zone 20 and lower lacing zone 22. Upper lace 14 is provided for tightening upper lacing zone 20 in the upper region 7 of boot body 3, and lower lace 16 is provided for tightening lower lacing zone 22 in the lower region 6 of boot body 3.

As discussed above, the use of multiple lacing zones provides a wearer with the ability to separately tighten different parts of the boot to desired tension(s). In the example shown in FIGS. 1-5, a wearer may tighten upper lacing zone 20 to one tension with upper lace 14 and lower lacing zone 22 to another tension with lower lace 16. The invention is not limited in this regard, however, as the boot may be divided into lacing zones in any desired manner, and need not be divided into an upper lacing zone and a lower lacing zone. Other two-zone configurations are also contemplated, and will occur to one of ordinary skill in the art. Likewise, more than two lacing zones (in any desired configuration) may be employed for additional flexibility, comfort and/or performance.

Figure 5:
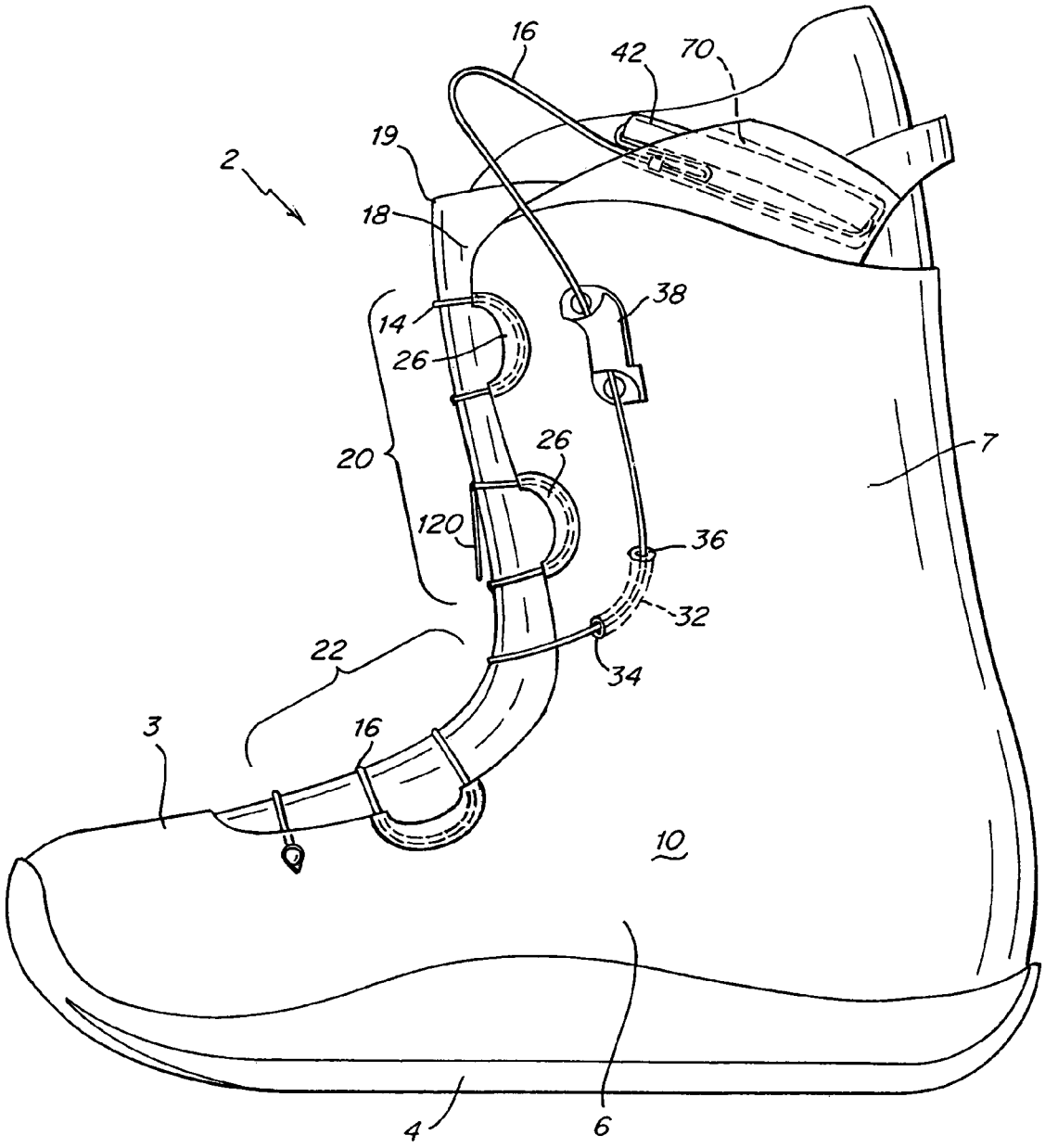
FIG. 5 is a side view of the boot of FIG. 1 showing the opposite side of the boot.

In one embodiment, lower lace 16 is anchored to the boot at position 24 toward the bottom of lower lacing zone 22 (e.g., in the toe-area of the boot), and is threaded through external lace guides 26, before entering internal lace guide tube or channel 32 disposed within the wall of medial side 10 of boot 2, through intake eyelet 34. Lower lace 16 extends through internal lace guide tube 32 and exits at an exit eyelet 36 (FIG. 5), to the upper region 7 of boot 2, where it is threaded through lace lock 38 (FIG. 5). In an analogous fashion, upper lace 14 is anchored to the boot at position 50 toward the top of upper lacing zone 20 in the upper region 7 of boot 2 (e.g., in the shin-area of the boot), and is threaded through lace guide(s) 26 and over hook 54 (described in more detail below), before entering internal lace guide tube or channel 58 disposed within the wall of the lateral side 12 of the boot 2, through intake eyelet 60. Upper lace 14 extends through internal lace guide tube 58 and exit eyelet 62, and is then threaded through lace lock 64, which is provided on the upper region 7 of boot 2. The invention is not limited, however, as other suitable configurations of laces, lace guides and lace locks may be employed.

For example, fewer or more lace guides may be provided for guiding each of the laces. The lace guides may be formed in any desired configuration. For example, they may comprise tubes to receive a lace, hooks, eyelets, posts, and any other configuration suitable to guide the lace through the lacing zone. While one such combination of internal and external lace guides in shown in FIGS. 1-5, other combinations are within the scope of the invention and will be apparent to one of ordinary skill in the art.

The invention also is not limited to any particular location for anchoring an end of a lace to the boot. For instance, instead of anchoring one end of upper lace 14 at the top of upper lacing zone 20, in another embodiment one end of upper lace 14 may be anchored at the bottom of upper lacing zone 20, or in any other appropriate location. The same holds true with respect to the anchoring of lower lace 16. Likewise, the lace locks 38 (FIG. 5) and 64 (FIGS. 1-4) need not necessarily be located at the top portion of the boot as shown; the lace locks may be located elsewhere, such as on a front portion of the boot.

In the embodiment illustrated in FIGS. 1-5, each of the laces 14 and 16 includes a free-end portion, graspable by the wearer, to tighten the lace. In one embodiment, the free-end portion may include a portion of lace that is looped back onto itself to create a handle to facilitate pulling the lace by a wearer. In particular, upper lace 14 includes handle 66, and lower lace 16 includes handle 42.

In operation, the wearer can pull on handles 66 and 42, which draws the laces in a tightening direction "A", to tighten the upper and lower lacing zones 20 and 22 sequentially or simultaneously. When each lacing zone has reached a desired tightness, the wearer may lock the respective laces in their corresponding lace locks, though which the laces are threaded. As described above, this action permits the user to achieve the sensation of tightening a conventional boot by pulling up on two free ends of laces. In addition, the need to progressively tighten a single lace from the bottom to the top of the boot is obviated, as is the need to tie a knot or bow at the top of the boot. In short, the wearer can tighten and secure the laces of the boot with a single motion.

Figure 6:
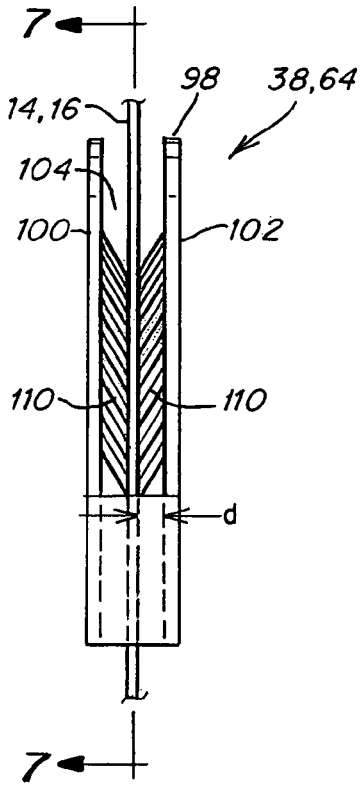
FIG. 6 is a plan view of an illustrative lace lock for use with the boot of FIG. 1.
Figure 7:
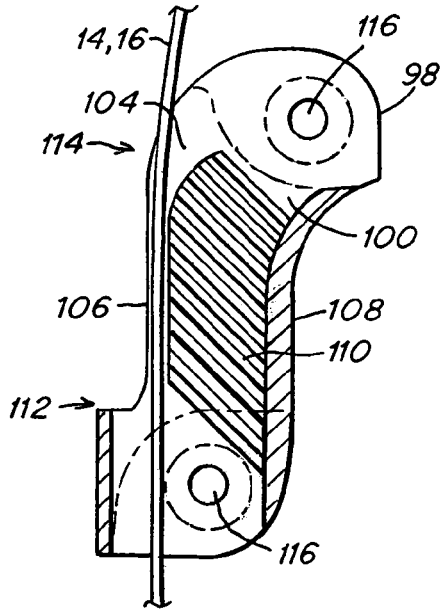
FIG. 7 is cross-sectional view of the lace lock of FIG. 6, taken along line 7-7.

To hold the lace in place, a lace lock may be employed. One particular embodiment of a lace lock is illustrated in FIGS. 6-7 and is shown as a cleat. The lace lock 38, 64 comprises a body 98 having two opposing walls, i.e., an inner wall 100 and an outer wall 102, between which is disposed a channel 104. The lace lock comprises a front 106 (which faces forward when the lace lock is mounted to the boot) and a back 108 (which faces backward when lace lock is mounted to the boot).

The inner wall 100 and outer wall 102 of the lace lock each comprise a plurality of locking teeth 110, which cooperate to form the cleat as depicted in FIG. 6. The depth "d" of the teeth 110 increases from the front 106 to the back 108 of the lace lock. Accordingly, the teeth 110 converge to form a wedge or "V" shaped cleat in the channel 104, within which a lace may be secured. The invention is not limited in this regard, as any appropriate arrangement of teeth, or any appropriate mechanism for securing the lace within the lace lock, may be employed.

As shown in FIG. 7, the teeth 110 closest to a bottom portion 112 of the lace lock begin at or close to the front edge 106 of the lace lock, whereas the teeth 110 closest to a top portion 114 of the lace lock are shorter, and begin farther from the front edge 106 of the lace lock. Accordingly, the teeth 110 closest to the bottom portion 112 of the lace lock are engaged first by the lace as the wearer pulls the lace from the front edge 106 of the lace lock toward the back end 108 of the lace lock, after which the lace engages the teeth 110 closest to the top portion 114 of the lace lock. The invention is not limited in this regard, however, and other configurations of the teeth 110 are contemplated.

The lace lock is secured to boot 2 at its inner wall 100 with fasteners (not shown) passing through holes 116. The invention is not limited in this regard, however, as other mechanisms for securing the lace lock to the boot may be employed, such as adhesives or sewing.

It should be appreciated that the invention is not limited to a particular arrangement for securing the lace, as any suitable mechanism may be employed. For example, the lace lack may be configured as a spring-loaded barrel lock, a capstan, a cam lock, post, or any other suitable device or arrangement.

To further facilitate securing the lace once the lace has been tightened, the lace lock may be oriented in a position so that a wearer can tighten and secure the laces in a single motion. In one embodiment, after the wearer has tightened the laces to a desired tension, the wearer simply pulls the laces toward the back edge 108 of the lace lock, which causes then to be trapped within the "V"-shaped cleat formed by teeth 110. This may be accomplished by orienting the lace lock on the boot in a manner such that channel 104 in the lace lock is substantially parallel to the tongue opening 18 (as shown in FIGS. 1-5). Alternatively, the lace lock may be configured such that upon relieving the tension in the lace, the lace automatically is held within the lace lock. The invention is not limited in this regard, however, as other single or multi-step locking arrangements may be employed The handles may be formed in a manner to relieve pressure points on the hand of the wearer as he or she pulls on the handle. In one example, each handle 42, 66 includes a tube through which the lace is passed. A fabric material may be placed over the tube, or if no tube is employed, the fabric may be placed over the lace. Suitable padding may also be employed.

In one embodiment, it may be advantageous to designate for the wearer to which zone the lace belongs. Thus, as shown in FIG. 1, handle 66 includes the label "UPPER ZONE" embroidered on or otherwise applied to the handle. Similarly, handle 42 includes the label "LOWER ZONE" embroidered on or otherwise applied, to the handle. The present invention is not limited in this respect, as other suitable designations may be employed, such as color coded or differently shaped handles. Suitable designations may alternatively be placed at or on the side of the boot. In addition, no designations need be employed, as the present invention is not limited in this respect.

Figure 3:
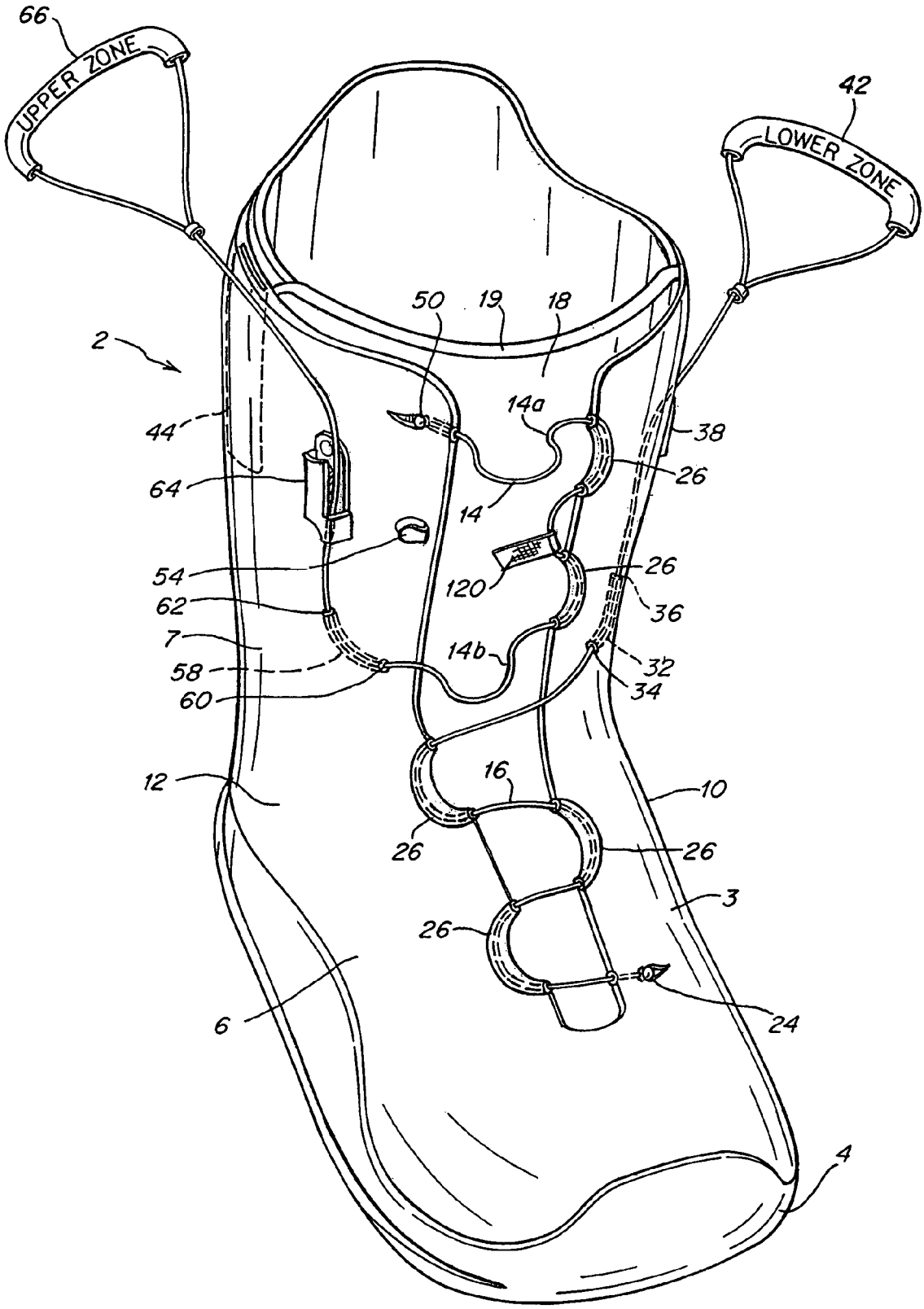
Figure 4:
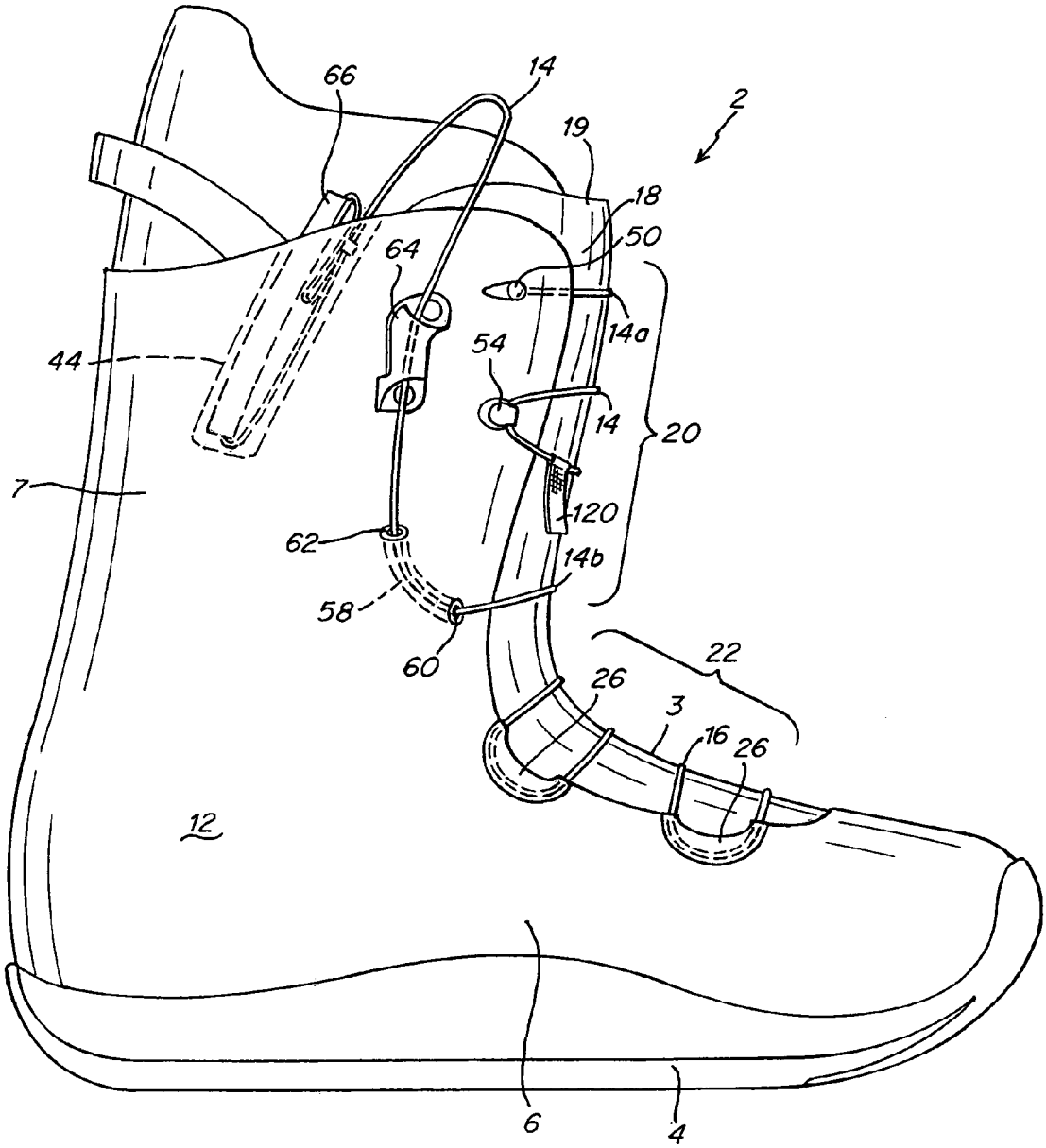
FIG. 4 is a side view of the boot of FIG. 1.

The handles 42 and 66 of laces 16 and 14 (as well as any excess lace after tightening) may be stowed to reduce excess lace that might otherwise hang off the boot and get in the wearer's way. In one embodiment, as shown in FIGS. 1-5, the boot may include pockets 44 and 70. In FIG. 4, handle 66 is shown stowed in pocket 44. In FIG. 5, handle 42 is shown stowed in pocket 70. In one embodiment, pockets 44 and 70 comprise elongate openings in the wall of the boot body 3, at or near the top of the boot 2, and extend in a substantially vertical direction. In another embodiment, the pocket may extend at an angle relative to the vertical position, as shown in FIG. 5.

It should be appreciated, however, that the invention is not limited in this regard, as pockets need not be provided (or, if provided, may be located elsewhere on the boot or in a different configuration).

In one embodiment, although not shown, a rotary closure device may be used in place of the lace lock. With such a device, the free ends of the laces may be threaded into the body of the device and wrapped around a spool as the spool is rotated to achieve the desired tension and the use of a pocket may not be necessary. Such closure devices are well known for use in other applications, such as for use with a cable tightening system to replace conventional laces in an athletic shoe, and examples of such rotary closure devices are described in U.S. Pat. Nos. 3,738,027; 3,808,644; 4,433,456; 4,616,524; 4,660,300; 4,748,726; 4,761,859; 4,787,124; 4,796,829; 4,841,649; 4,884,760; 4,961,544; 5,042,177; 5,065,481; 5,150,537; 5,152,038; 5,157,813; 5,325,613; 5,600,874; 5,606,778; 5,638,588; and 5,669,116; and European patent applications EP056,953 and EP264,712. It should be appreciated that the present invention is not limited to the use of any particular type of closure device, as any mechanism that is capable of taking up slack in the lace can be used in connection with the present invention.

In another embodiment, also not shown, a lace recoil device may be employed. The free end of the lace is anchored to a self-winding spool such that after the desired tension is applied to the lace, the recoil action of the spool would take up excess lace. Again, with such a device the use of a pocket may not be necessary. The recoil device may include a lock to hold the lace at a desired tension.

Figure 8:
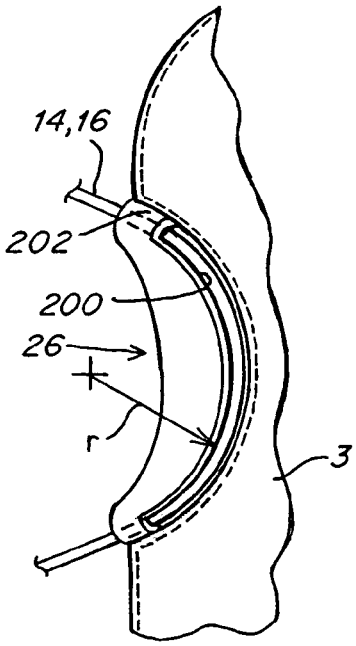
FIG. 8 is a perspective view of an illustrative lace guide for use with the boot of FIG. 1.

Returning to the embodiment shown in FIGS. 1-5, the lace guides 26 may have semi-circular or generally "C" shaped guiding surfaces. An enlarged rear perspective view of one lace guide 26 is shown in FIG. 8, with the guiding surface bearing reference numeral 200. As shown in FIG. 8, the lace guide is partially closed, by closure portions 202, to capture the lace and prevent the lace from dislodging from the lace guide when tension in the lace is relieved. The invention is not limited in this regard, however, and any appropriate configuration of the lace guide to trap the lace may be used. For example, the lace guide may comprise a tube. In another example, the back portion of the lace guide may comprise a piece of flexible material to block the lace from becoming dislodged when tension in the lace is relieved. Other configurations are also contemplated and will readily occur to one of ordinary skill in the art.

In one embodiment, the radius of curvature "r" of the guide surface provides a gradual reversal of direction for the lace. Such a gradual reversal reduces kink points and reduces the chance that the lace will bind in the guide. In this manner, the efficiency with which the force applied to the lace is translated to the tightening tension on the lace is maximized. That is, drag or other losses are minimized. In one embodiment, the radius of curvature "r" is approximately ½ inch. Other suitable radii of curvature, or other suitable shapes for the lace guide, may be employed as the present invention is not limited in this respect.

The lace guides are made from a low-friction material, such as teflon, to reduce frictional drag on the laces. The invention is not limited in this regard, however, as the lace guides can be made from any appropriate material, such as metal or fabric.

As noted above, another aspect of the invention relates to creating slack in a lace to facilitate loosening and removing the boot. In this aspect, an open hook 54 (also referred to as "speed hook 54") is provided on the boot body 3, the speed hook 54 being adapted to permit the lace to dislodge from the speed hook 54 when desired by the wearer. As depicted in FIGS. 1-4, the speed hook 54 is provided in the upper lacing zone 20 for cooperation with the upper lace 14. The invention is not limited in this regard, however, as a speed hook 54 may be used in connection with the lower lacing zone 22 (or one or more other lacing zones) as well. The hook 54 may be configured in any suitable manner and formed of any suitable material, as the present invention is not limited in this respect. In one embodiment, the hook 54 is formed of a material similar to the other lace guides, but is smaller, where the radius of curvature is either the same (e.g., approximately ½ inch) or smaller (e.g., ¼ or ⅛ inch).

Further, as shown, the hook 54 is disposed between two lace guides 26 such that, upon dislodging the lace from the hook 54, the ends of lace on either side of the hook are still captured by the other lace guides. In this manner, upon re-tightening the boot, the wearer need only to re-engage the lace with the hook 54, rather than with several of the other lace guides 26. However, the present invention is not limited in this respect, and the lace hook 54 may be positioned in other suitable locations and/or additional lace hooks may be employed. In other embodiments, the lace may be removable from any one or more of the lace guides.

A pull tab 120 (also referred to as a "release strap") is provided on the lace (in this case upper lace 14) and includes a graspable portion to facilitate movement of lace 14 onto and off of the speed hook 54. In one embodiment, the release strap is formed from a strip of material, for example, fabric, that is stitched onto the lace. The strap may be attached to the lace in a manner that allows it to slide along the lace. In one embodiment, a portion of the strip of material is folded over the lace and back onto itself to form a loop that surrounds the lace, and sewn closed. The invention is not limited in this regard, however, as the release strap may be formed using other techniques, or may be formed into other structures, such as a solid piece of material with a channel formed therein to receive the lace. Alternatively, absent such structures, the wearer may move the lace onto and off of the hook with a finger.

In this aspect, the wearer unhooks the lace 14 from the speed hook 54 (with or without release strap 120, as noted above), as shown in FIG. 2, to create slack in the lace 14. This slack may be transferred to adjacent lace portions 14*a*, 14*b*, as shown in FIG. 3, enabling the wearer to more easily remove the boot from the foot by, for example, moving the tongue away from the wearer's leg, which is now largely unrestricted due to the slack in the lace.

By allowing the lace to become dislodged from the lace hook 54, the need for the lace to pass back through the lace lock is minimized. As shown in FIG. 1, the amount of lace "L" at the free end of lace 14 that extends generally between the lace lock 64 and position 122 of handle 66 (i.e., where the lace 14 re-unites with itself after being formed into a handle loop) is minimal so that a large amount of lace is not hanging off the boot or otherwise need to be stowed. This length of lace ("L") is less than an amount of lace typically desired to produce enough slack lace to facilitate easy removal of the boot. That is, upon disengaging the lace 14 from the lace lock 64 and pulling the lace 14 back through the lace lock 64 in a loosening direction "B", the lace will only move until position 122 abuts the lace lock 64. No additional amount of lace 14 can pass through lace lock 64 in direction "B". Therefore, to create additional slack in the lace 14, the lace 14 is unhooked from hook 54, as shown in FIGS. 2 and 3, to aid the wearer in removing the boot.

Figure 2:
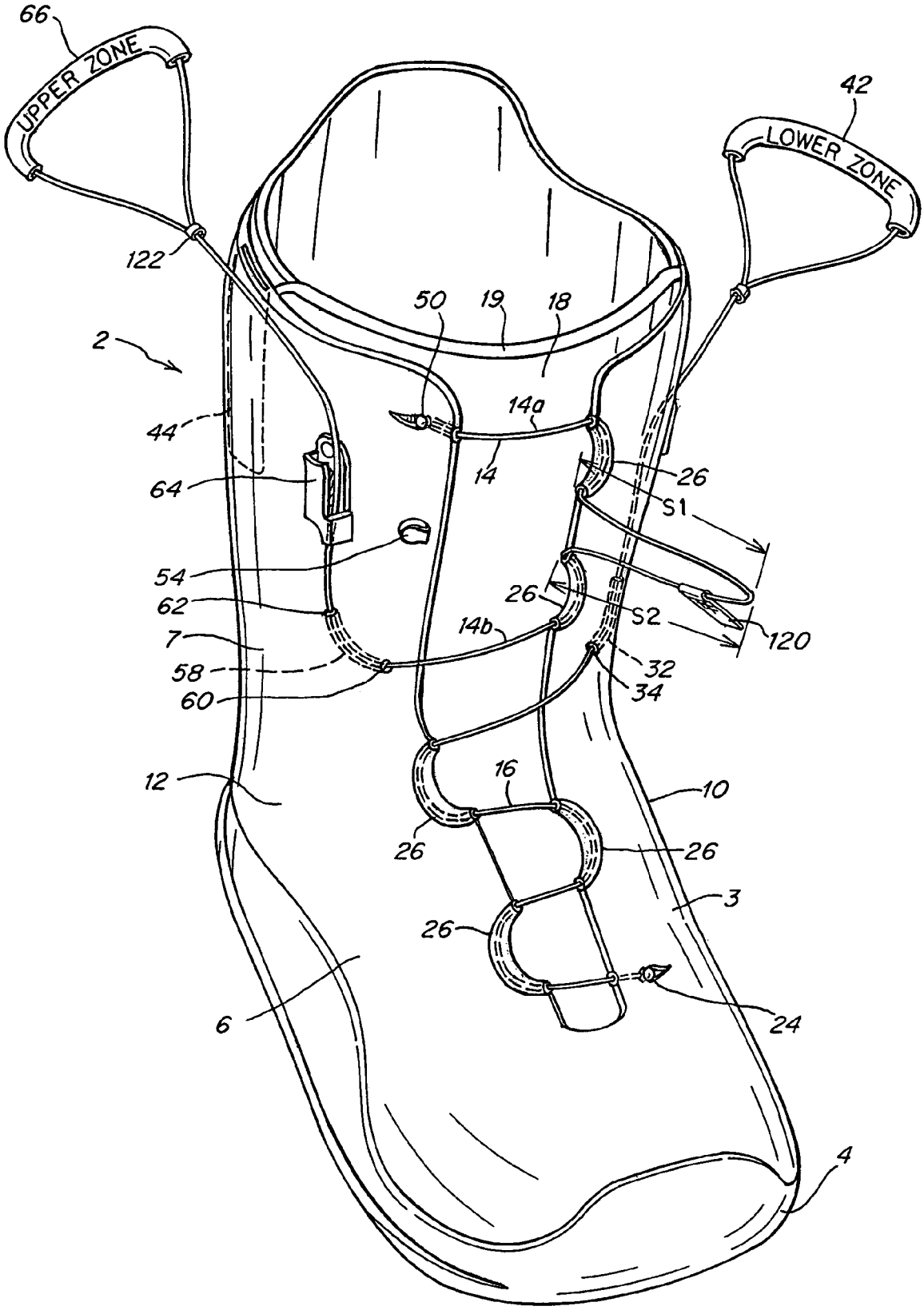
FIGS. 2 and 3 are perspective views of the boot of FIG. 1 with a slackened lace.

In one embodiment, the amount of slack created in the lace 14 by unhooking the lace 14 from the speed hook 54 ("S1" and "S2", as shown in FIG. 2) exceeds an amount of lace "L" available to pass through the lace lock 64 in the loosening direction "B". In one embodiment, this amount of lace ("S1" and "S2") creates sufficient slack by itself that unlocking the lace 14 from the lace lock 64 is not necessary for removal of the boot 2. In another embodiment, the amount of lace ("S1" and "S2") plus the additional amount "L" provided upon unlocking the lace 14 form the lace lock 64 produces sufficient slack to facilitate boot removal.

In one embodiment, the amount of lace "L" at the free-end of the lace 14 is approximately 3 inches. The amount of lace "S1" and "S2" together is approximately 9 inches. However, it should be appreciated that the present invention is not limited in this respect, as other suitable lengths may be employed.

The laces 14 and 16 can be implemented in any of numerous ways, and the present invention is not limited to any particular implementation. The laces 14 and 16 should be sufficiently strong to resist the substantial forces that can be encountered when snowboarding, and in this respect may require greater strength than the laces employed in conventional footwear such as athletic shoes. The laces 14 and 16 can be formed from a monofilament or a multistrand line. In accordance with one illustrative embodiment of the invention, the laces 14 and 16 are formed of a low-friction material capable of resisting a high tensile force without elongation to minimize frictional engagement between the laces 14 and 16 and the lace guides 26, and thereby facilitate even pressure distribution throughout the respective lacing zones 20 and 22. While not limited to any particular material or any particular form (i.e., woven, braided, monofilament, etc.), examples of materials that can be used for the laces 14 and 16 include various types of fabrics, plastics, metals, Kevlar and/or Spectra Cord.

The boot 2 may be configured as a soft boot employing soft, flexible materials such as leather, fabrics, plastics (e.g., non-rigid plastics) or other suitable natural or manmade materials. A liner (not shown) may also be employed and inserted into the interior region of the boot, however, the present invention is not limited in this respect. A tongue stiffener, whether removable or not, may be employed to stiffen an otherwise flexible tongue. An example of a tongue stiffener may be found in commonly assigned U.S. Pat. No. 6,360,454, which is hereby incorporated herein by reference.

In the embodiments shown, the laces 14 and 16 follow a meandering path and do not cross over themselves, unlike many conventional laces that cross over themselves while "criss-crossing" the tongue opening 18. The invention is not limited in this regard, however, and other lacing patters may be used as will be apparent to one of ordinary skill in the art. For example, a lacing pattern in which the laces cross over themselves may be employed.

It should be understood that the foregoing description of the invention is intended merely to be illustrative thereof and that other embodiments, modifications, and equivalents of the invention are within the scope of the invention recited in the claims appended hereto. Further, although each embodiment described above includes certain features, the invention is not limited in this respect. Thus, one or more of the above-described or other features of the boot or methods of use, may be employed singularly or in any suitable combination, as the present invention is not limited to a specific embodiment.

What is claimed is:

1. A method of using a boot, the boot having a boot body, a plurality of lace guides coupled to the boot body, at least one lace guided by the lace guides, and at least one lace lock cooperating with the at least one lace and engaging the at least one lace so that the at least one lace is holdable toward a tightening direction to tighten the boot body about a wearer, the at least one lace adapted to have an end portion extending from the at least one lace lock after the at least one lace has been tightened, wherein an amount of slack lace provided by the end portion of the at least one lace upon disengaging the at least one lace from the at least one lock may be insufficient to permit easy removal of the boot from the wearer, the method comprising:

removing the at least one lace from at least one lace guide to create a length of slack in the at least one lace to aid in permitting removal of the foot from the boot; and drawing the lace through at least one of the other lace guides in a loosening direction.

2. The method of claim 1, wherein the boot further comprises a release strap coupled to the at least one lace, wherein removing the at least one lace from at least one lace guide comprises grasping the release strap.

3. The method of claim 1, further comprising:

disengaging the at least one lace from the at least on lace lock to create an additional length of lace slack that cooperates with the length of lace slack created upon removing the at least one lace from at least one lace guide to permit easy removal of the boot.

4. The method of claim 1, wherein the boot body further comprises a lower, foot region adapted to cover a foot of the wearer, and an upper, shin region adapted to cover at least a portion of a shin of the wearer, wherein the at least one lace comprises a lower lace cooperating with the lower region and an upper lace cooperating with the upper region, the method further comprising:

drawing the lower lace in the tightening direction to tighten the lower region of the boot body; and drawing the upper lace in the tightening direction to tighten the upper region of the boot body.

5. The method of claim 4, further comprising drawing the upper and lower laces independently of each other to achieve different levels of tightness in the upper and lower regions, respectively.

6. The method of claim 4, further comprising securing the upper and lower laces at the upper region of the boot body.

7. The method of claim 6, further comprising simultaneously securing the upper and lower laces at the upper region of the boot body.

8. The method of claim 6, wherein the boot body includes a rear side, the method further comprising securing the upper and lower laces at the upper region of the boot body and forward of the rear side.

9. The method of claim 4, wherein the boot further comprises a first handle coupled to the lower lace and a second handle coupled to the upper lace, wherein drawing the lower lace comprises pulling the first handle and wherein drawing the upper lace comprises pulling the second handle.

10. The method of claim 9, wherein the boot further comprises first and second pockets formed in the boot body, the first pocket is adapted to receive the first handle and the second pocket is adapted to receive the second handle, the method further comprising inserting the first handle at least partially into the first pocket after the lower lace has been drawn to tighten the lower region, and inserting the second handle at least partially into the second pocket after the upper lace has been drawn to tighten the upper region.

11. A method of using a boot, the boot having a boot body having a lower region adapted to cover a foot of a wearer and an upper region adapted to cover at least a portion of a shin of the wearer, the upper region including a side region, the boot further having at least one lace, at least one handle coupled to the at least one lace and graspable by a wearer, and at least one lace lock cooperating with the at least one lace and engaging the at least one lace so that the at least one lace is holdable to at least partially tighten the boot body about the wearer, the method comprising:

grasping the at least one handle to draw the at least one lace in a tightening direction;

securing the at least one lace by the at least one lace lock; and stowing the at least one handle at the side region of the boot body in the upper region of the boot body.

12. The method of claim 11, wherein the boot body further comprises a first pocket disposed in the side region, the method further comprising inserting the at least one handle at least partially into the first pocket.

13. The method of claim 11, wherein the at least one lace comprises a lower lace cooperating with the lower region and an upper lace cooperating with the upper region, the method further comprising:

drawing the lower lace in the tightening direction to tighten the lower region of the boot body; and drawing the upper lace in the tightening direction to tighten the upper region of the boot body.

14. The method of claim 13, wherein the at least one handle comprises a first handle coupled to the first lace and a second handle coupled to the second lace, and wherein the side region comprises a first side region and a second side region, the method further comprising storing the first handle at the first side region of the boot body in the upper region of the boot body and storing the second handle at the second side region of the boot body in the upper region of the boot body.

15. The method of claim 14, wherein the boot body further comprises a first pocket disposed in the first side region and a second pocket disposed in the second side region, and wherein the at least one handle comprises, the method further comprising inserting the at least one handle at least partially into the first pocket.

16. The method of claim 13, further comprising drawing the upper and lower laces independently of each other to achieve different levels of tightness in the upper and lower regions, respectively.

17. The method of claim 13, further comprising securing the upper and lower laces at the upper region of the boot body.

18. The method of claim 17, further comprising simultaneously securing the upper and lower laces at the upper region of the boot body.

19. The method of claim 17, wherein the boot body includes a rear side, the method further comprising securing the upper and lower laces at the upper region of the boot body and forward of the rear side.

20. A method of using a boot, the boot having a boot body, a plurality of lace guides coupled to the boot body, a lower region adapted to cover a foot of a wearer, an upper region adapted to cover at least a portion of a shin of the wearer, and a tongue opening disposed in a shin-toe direction and a tongue disposed within the tongue opening, wherein the boot body further comprises medial and lateral sides with the tongue opening locatable between the medial and lateral sides, wherein a first lacing zone is adapted to draw the medial and lateral sides toward each other to tighten a first region of the boot body and wherein a second lacing zone is adapted to draw the medial and lateral sides toward each other to tighten a second region of the boot body, wherein a lace of the first and second lacing zones has a portion that is disposed in the upper region, the method comprising:

securing the lace of the first lacing zone in the upper region to tighten the first lacing zone; and securing the lace of the second lacing zone in the upper region to tighten the second lacing zone.

21. The method of claim 20, wherein securing the lace of the first lacing zone in the upper region to tighten the first lacing zone comprises securing a first lace; and wherein securing the lace of the second lacing zone in the upper region to tighten the second lacing zone comprises securing a second lace that is separate from the first lace.

22. The method of claim 20, wherein the lace cooperates with at least one lace lock and engages with the at least one lace lock so that the lace is holdable toward a tightening direction to tighten the boot body about a wearer, the lace adapted to have an end portion extending from the at least one lace lock after the lace has been tightened, wherein an amount of slack lace provided by the end portion of the lace may be insufficient to permit easy removal of the boot from the wearer, the method further comprising:

removing the lace from at least one lace guide to create a length of slack in the first lacing zone to aid in permitting removal of the foot from the boot.

23. The method of claim 20, further comprising simultaneously securing the first lacing zone and the second lacing zone.

24. The method of claim 20, further comprising securing the first lacing zone and the second lacing zone to achieve different levels of tightness in the first and second regions, respectively.

25. The method of claim 20, wherein the boot body includes a rear side, the method further comprising securing the lace of the first and second lacing zones at the upper region of the boot body and forward of the rear side.

26. The method of claim 20, wherein the boot further comprises a first handle coupled to the lace of the first lacing zone and a second handle coupled to the lace of the second lacing zone, the method further comprising pulling the first handle and pulling the second handle to draw the lace of the first lacing zone and the second lacing zone.

27. The method of claim 26, wherein the boot further comprises first and second pockets formed in the boot body, the first pocket is adapted to receive the first handle and the second pocket is adapted to receive the second handle, the method further comprising inserting the first handle at least partially into the first pocket, and inserting the second handle at least partially into the second pocket.

* * * * *

UNITED STATES PATENT AND TRADEMARK OFFICE

CERTIFICATE OF CORRECTION

PATENT NO. : 7,293,373 B2
APPLICATION NO. : 11/286643
DATED : November 13, 2007
INVENTOR(S) : Greg Reagan et al.

It is certified that error appears in the above-identified patent and that said Letters Patent is hereby corrected as shown below:

Col. 1, lines 6-9 should read:

This application is a divisional and claims the benefit under 35 U.S.C. § 120 of U.S. Application Serial No. 10/732,834, filed on December 10, 2003, now U.S. Patent No. 7,281,341 which is herein incorporated by reference in its entirety.

Signed and Sealed this

Twelfth Day of August, 2008

JON W. DUDAS
*Director of the United States Patent and Trademark Office*